US006609669B2

(12) United States Patent
Rakocy et al.

(10) Patent No.: US 6,609,669 B2
(45) Date of Patent: Aug. 26, 2003

(54) HYDRAULIC LOADING SYSTEM FOR BALL AND RING PULVERIZERS

(75) Inventors: Michael E. Rakocy, North Canton, OH (US); Rodney C. Pifer, Akron, OH (US); David P. Houser, Copley, OH (US)

(73) Assignee: The Babcock & Wilcox Company, New Orleans, LA (US)

( * ) Notice: Subject to any disclaimer, the term of this patent is extended or adjusted under 35 U.S.C. 154(b) by 7 days.

(21) Appl. No.: 09/948,823

(22) Filed: Sep. 7, 2001

(65) Prior Publication Data

US 2003/0047629 A1 Mar. 13, 2003

(51) Int. Cl.[7] ..... B02C 15/00
(52) U.S. Cl. ..... 241/103; 241/132
(58) Field of Search ..... 241/103, 117–121, 241/132, 133

(56) References Cited

U.S. PATENT DOCUMENTS

| | | | | |
|---|---|---|---|---|
| 1,889,555 | A | | 11/1932 | King |
| 2,595,587 | A | | 5/1952 | Leach |
| 2,670,138 | A | | 2/1954 | King et al. |
| 2,909,330 | A | | 10/1959 | Hardinge |
| 3,199,794 | A | | 8/1965 | Poole |
| 3,782,646 | A | | 1/1974 | Brundiek |
| 3,881,348 | A | | 5/1975 | Morton |
| 4,002,299 | A | | 1/1977 | Skalka |
| 4,372,496 | A | | 2/1983 | Maliszewski |
| 4,432,500 | A | | 2/1984 | Brundiek et al. |
| 4,485,974 | A | | 12/1984 | Lass |
| 4,694,997 | A | | 9/1987 | Schonbach |
| 4,705,223 | A | * | 11/1987 | Dibowski et al. ..... 241/117 |
| 4,828,189 | A | | 5/1989 | Schonbach |

OTHER PUBLICATIONS

*Steam*, Its Generation and Use, 40th Edition, The Babcock & Wilcox Company, ©1992, Chapter 12 Coal Pulverization, pp. 12–1 to 12–15.

Brochure entitled, "B&W Pulverizer Type EL for Pulverized–Fuel Firing Systems" published 1956 by The Babcock & Wilcox Company, New York, NY, USA pp. 8, 13–15.

Brochure entitled "The DB Riley MPS Pulverizer" published 1999 by DB Riley, Inc., Worcester, MA, USA, p. 1, pp. 5–7.

* cited by examiner

*Primary Examiner*—Mark Rosenbaum
(74) *Attorney, Agent, or Firm*—Kathryn W. Grant; Eric Marich

(57) ABSTRACT

An hydraulic loading assembly for ball and ring coal pulverizers has a plurality of compression assemblies connected to a common hydraulic controller for exerting equal pressure simultaneously on each of the compression assemblies. The compression assemblies each have a hydraulic cylinder and piston located above and connected to a non-threaded rod which is in turn located above and connected to a compression spring exerting force on the top grinding ring of the pulverizer.

7 Claims, 5 Drawing Sheets

HYDRAULIC LOADING SYSTEM FOR BALL AND RING PULVERIZERS

FIELD AND BACKGROUND OF THE INVENTION

1. Field of the Invention

The present invention relates generally to the field of pulverizers for grinding combustion fuels, such as coal, and, in particular, to a new and useful hydraulic loading system for the top grinding ring of ball and ring pulverizers, such as the type E and EL coal pulverizers made by The Babcock & Wilcox Company.

2. Description of the Related Art

Coal pulverizers are used to grind, dry and classify raw chunks of coal into fine solids which can be fluidized and fed, for example, to burners used in conjunction with industrial or utility boilers or furnaces. E and EL type pulverizers are ball and ring (or ball and race) type pulverizers which employ the ball-bearing principle to grind the coal. Presently known E and EL type pulverizers use a pair of vertical axis, horizontal grinding rings, that surround a number of balls arranged between the rings, to pulverize coal. The lower or bottom grinding ring rotates through connection to a rotating, vertical main shaft, while the upper or top grinding ring remains stationary and is spring loaded to create grinding pressure.

The coal is ground by contact with the upper and lower grinding rings and balls (collectively grinding elements). The lower and upper grinding rings are each provided with a race having a predefined, matching track contour that engages the balls. The force from the upper grinding ring pushes the balls against the coal layer on the lower grinding ring. The grinding rings and the balls are made of abrasion resistant alloys and comprise the major wear parts of the pulverizer. The balls wear evenly and remain spherical, since the balls are free to rotate in all directions within the confines of upper and lower grinding rings. Ground coal is swept from the grinding zone defined by the grinding rings and the balls by air for final particle size classification and subsequent pneumatic transport to one or more coal burners.

FIG. 1 shows a cross section of a B&W type EL pulverizer generally depicted as numeral 2. This type of pulverizer has a stationary top ring 4, one rotating bottom ring 6, and one set of balls 8 that comprise the grinding elements. The pulverizer includes a cylindrical housing 20. The pressure required for efficient grinding is obtained from externally adjustable, dual purpose springs 10. The bottom ring 6 is driven by the yoke 12 which is attached to a vertical main shaft assembly 14 of the pulverizer. The top ring 4 is loaded by the dual purpose springs 10 which provide the desired grinding pressure and hold the top ring 4 stationary. Raw coal is fed into the grinding zone where it mixes with partially ground coal that forms a circulating load. Pulverizer air causes the coal to circulate through the grinding elements where some of it is pulverized in each pass through the row of balls 8. As the coal becomes fine enough to be picked up by the air conveyed into the pulverizer around the perimeter of the bottom ring 6, it is carried to the classifier where coal of a desired fineness is separated from the stream of air and pulverized coal, and is carried out with the air. Oversized material is returned to the grinding zone.

The pulverizer is driven by bevel gears provided on the underside of the bottom ring 6 which engage corresponding bevel gear teeth on horizontal pinion shaft 16 provided in the base of the pulverizer 2. Both the vertical main shaft 14 and the horizontal pinion shaft 16 are mounted in roller bearings. Forced lubrication is provided for the entire gear drive by an oil pump submerged in the oil reservoir and gear-driven from the pinion shaft.

For further details of such EL type pulverizers, the reader is referred to Chapter 12 of *Steam/its generation and use,* 40$^{th}$ Edition, Stultz and Kitto, Eds., Copyright©1992, The Babcock & Wilcox Company, the text of which is hereby incorporated by reference as though fully set forth herein.

One of the main requirements for grinding coal in a pulverizer of this type is adequate loading on the grinding elements. EL pulverizer top grinding rings have historically been loaded, and horizontal/rotational movement restricted, by using up to six single coil, dual purpose springs 10. The springs 10 apply a predetermined grinding pressure, as dictated by the grindability of the fuel and fineness required, to the non-rotating top ring 4. The springs 10 also permit vertical movement of the top ring to compensate for variations in size of pieces of fuel and foreign material that pass through the grinding elements. Additionally, the springs 10 prevent rotation of the top ring 4, and, by eliminating rubbing of contact surfaces, thereby reduce pulverizer maintenance. As the grinding elements wear, the pressure is restored by adjusting screw-down bolts that pass through brackets attached to the top of the housing 20.

FIG. 2 illustrates a known mechanism for applying a load to the grinding balls 8 of a ball and ring pulverizer 2 as taught in U.S. Pat. No. 2,595,587 to Lester L. Leach and assigned to The Babcock & Wilcox Company, the text of which is hereby incorporated by reference as though fully set forth herein. The mechanism has a set of spring loading assemblies 200 connected to the compression springs 10 for applying the load to the top grinding ring 4. Individual threaded rods 24 and captive nuts 58 in each of the spring loading assemblies 200 are used to adjust the load applied to each spring 10. The compression spring 10 of each spring loading assembly 200 is loaded individually by rotating the associated captive nut 58 to move the threaded rod 24 vertically, thereby increasing or decreasing the degree of load applied to each compression spring 10.

Maintaining the proper load on the grinding elements of ball and ring pulverizers is critical to their operation. As the balls and rings wear, the top ring 4 moves closer to the rotating bottom ring 6, and the loading spring compression relaxes, reducing the grinding force. The force reduction in turn causes a drop in the pulverizer capacity and coal fineness. With the mechanism described above, the pressure exerted upon the grinding elements can be suitably adjusted to compensate for the ring and ball wear without altering the restraining forces exerted by the springs 10 in a plane normal to the coil axes of springs 10. Each set of compression springs 10 and spring loading assemblies 200, however, must be individually loaded and calibrated with the remaining sets to ensure that an even loading is provided on the top grinding ring 4 and balls 8.

With conventional spring loading assemblies, the pulverizer must typically be shut down in order to reset the compression on the springs 10 and ensure even operation of the pulverizer. Large tools must be used to turn the captive nut 58 and adjust the loading in a time-consuming procedure. The procedure requires workers to be on top of the pulverizer to make some of the adjustments as well, creating a risk of injury to the worker.

SUMMARY OF THE INVENTION

It is an object of the present invention to provide an apparatus for rapid and uniform loading of the grinding balls used in a ball and ring coal pulverizer.

It is a further object of the invention to provide a hydraulic loading system having a central control for centrally applying a load to the top grinding ring of a coal pulverizer.

Yet another object of the invention is to provide a loading system for ball and ring pulverizers which accommodates wear of the grinding assembly without lengthy maintenance shutdowns.

Accordingly, a hydraulic loading system for applying a compressive load to the top grinding ring of a ball and ring coal pulverizer is provided. The hydraulic loading system replaces conventional, threaded spring bolt assemblies with linearly loaded, non-threaded spring bolt assemblies. A hydraulic cylinder and piston assembly is mounted above each spring. The high-pressure connections of all the hydraulic cylinder and piston assemblies are piped in parallel and joined at a common manifold. The low-pressure connections are arranged in the same manner using a separate manifold and piping. The hydraulic cylinder and piston assemblies are thus controlled simultaneously using a single hydraulic pressure source. The hydraulic cylinder and piston assemblies each drive the corresponding non-threaded spring bolt to compress the associated pulverizer spring, thereby adjusting the load on the top grinding ring which is applied to the rest of the pulverizer grinding components.

In one embodiment the hydraulic loading system comprises a hydraulic loading system for a ball and ring coal pulverizer for producing fine coal for combustion in a coal-fired furnace or boiler from a raw coal, the pulverizer having a housing, a stationary top grinding ring, a plurality of grinding balls and a rotating lower grinding ring, the hydraulic loading system for applying a uniform compressive force exerted on the top grinding ring and grinding balls against the lower grinding ring, the hydraulic loading system further comprising a plurality of hydraulic cylinder and piston assemblies mounted on the upper portion of the housing, a corresponding plurality of non-threaded rods, each rod connected to one of the pistons of the plurality of hydraulic cylinder and piston assemblies and passing through the upper portion of the housing, a corresponding plurality of compression springs, each compression spring connected, within the housing, between a corresponding non-threaded rod and the stationary top grinding ring, and control means connected to each of the plurality of hydraulic cylinder and piston assemblies for simultaneously generating the same pressure in each hydraulic cylinder and piston assembly for exerting the uniform compressive force on the top grinding ring.

In another embodiment the hydraulic loading system comprises a hydraulic loading system for a ball and ring coal pulverizer for producing fine coal for combustion in a coal-fired furnace or boiler from a raw coal, the pulverizer having a housing, a stationary top grinding ring, a plurality of grinding balls and a rotating lower grinding ring, the hydraulic loading system for applying a uniform compressive force exerted on the top grinding ring and grinding balls against the lower grinding ring, the hydraulic loading system comprising a plurality of non-threaded rods slidably inserted through an upper portion of the housing of the pulverizer, a corresponding plurality of compression springs, each of the plurality of compression springs connected between each of the plurality of non-threaded rods and the top grinding ring, and hydraulic means using hydraulic pressure for simultaneously and uniformly exerting a force on each of the plurality of non-threaded rods to compress each of the plurality of compression springs a uniform amount and exert the uniform compressive force against the top grinding ring, said hydraulic means mounted on the upper portion of said housing.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
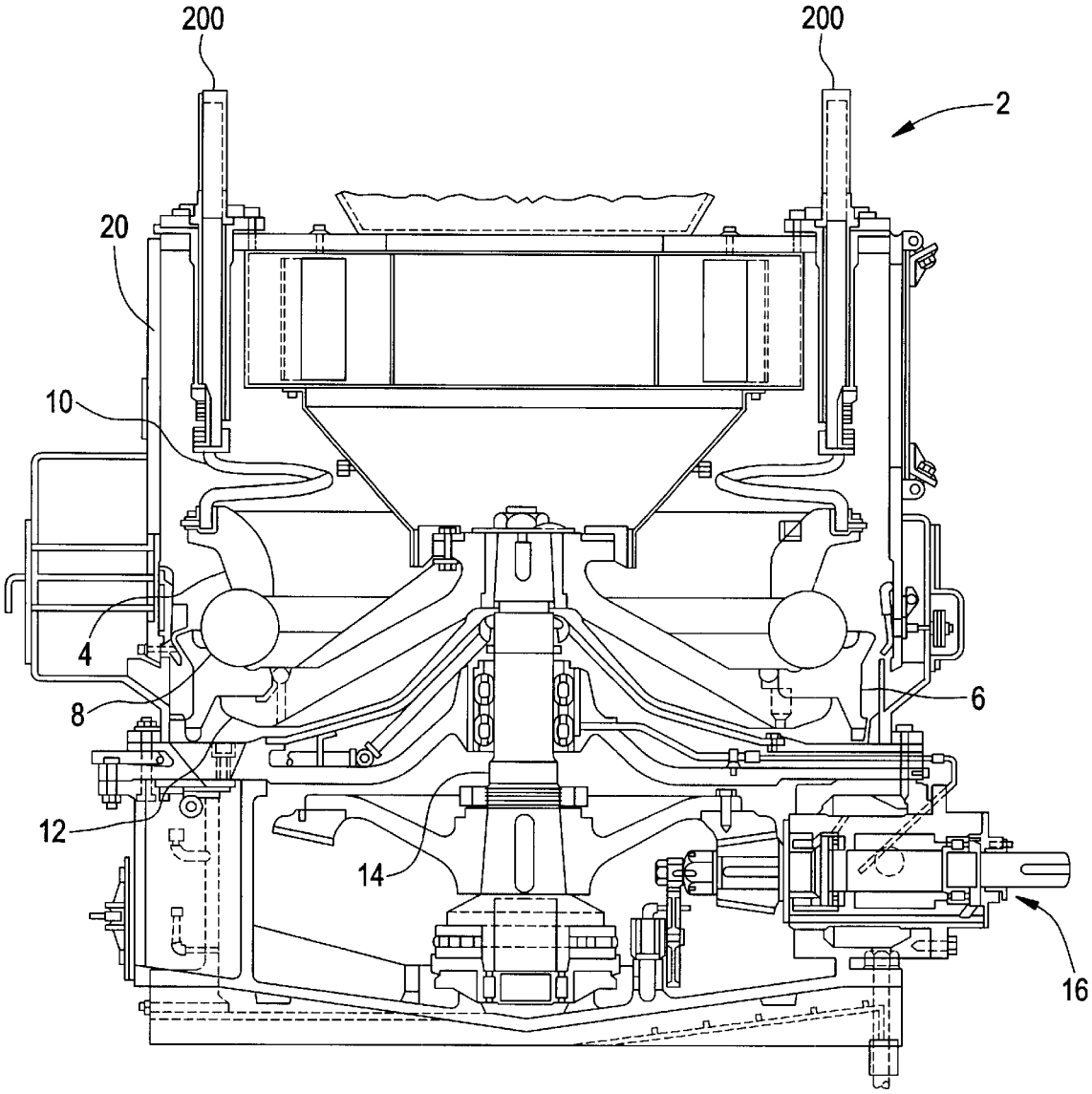
FIG.1 PRIOR ART
FIG. 1 is a sectional view of a known B&W type EL ball and ring pulverizer.
Figure 2:
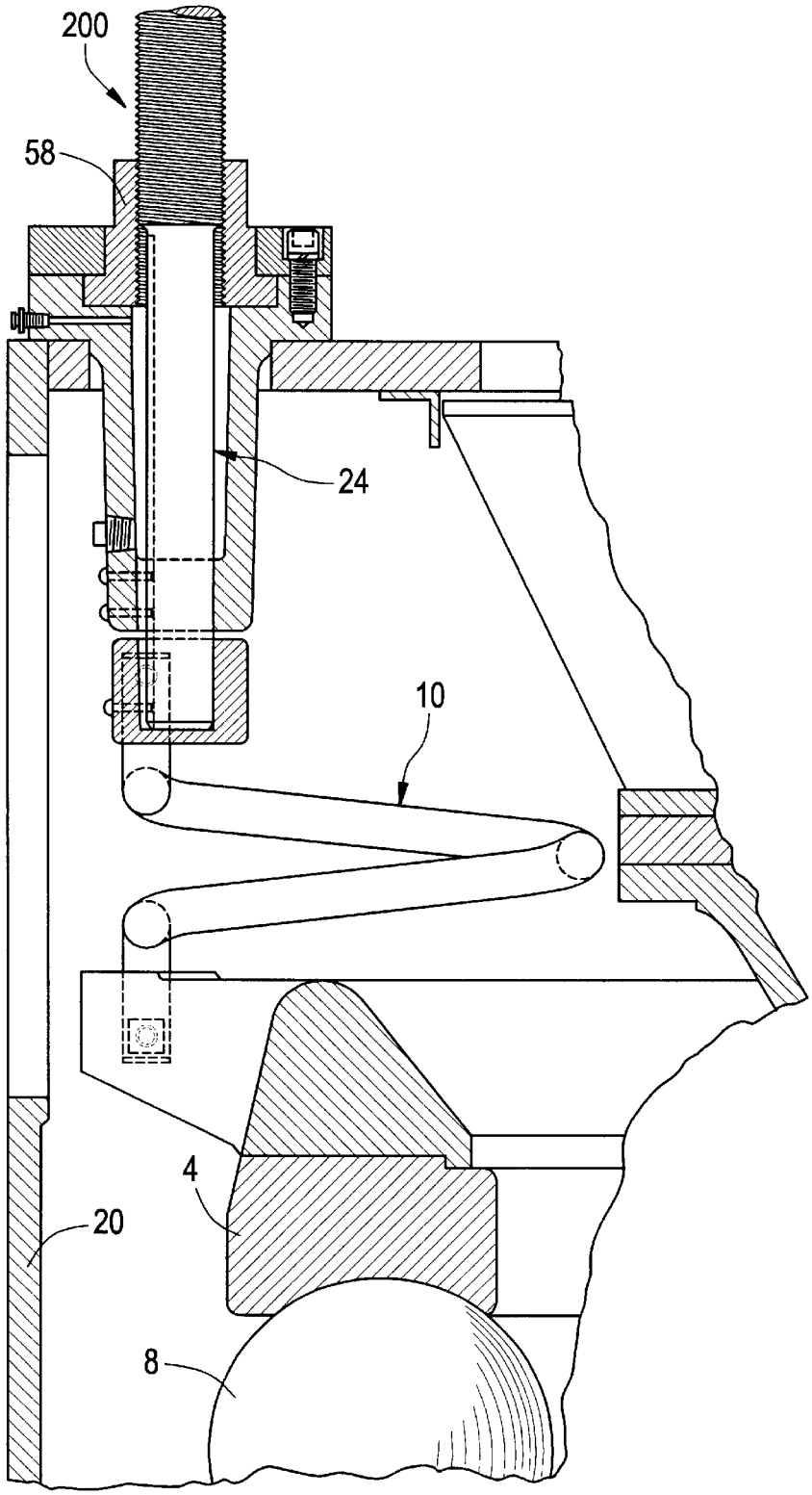
FIG. 2 PRIOR ART
FIG. 2 is a partial sectional view of a known loading system for a B&W ball and ring pulverizer.
Figure 3:
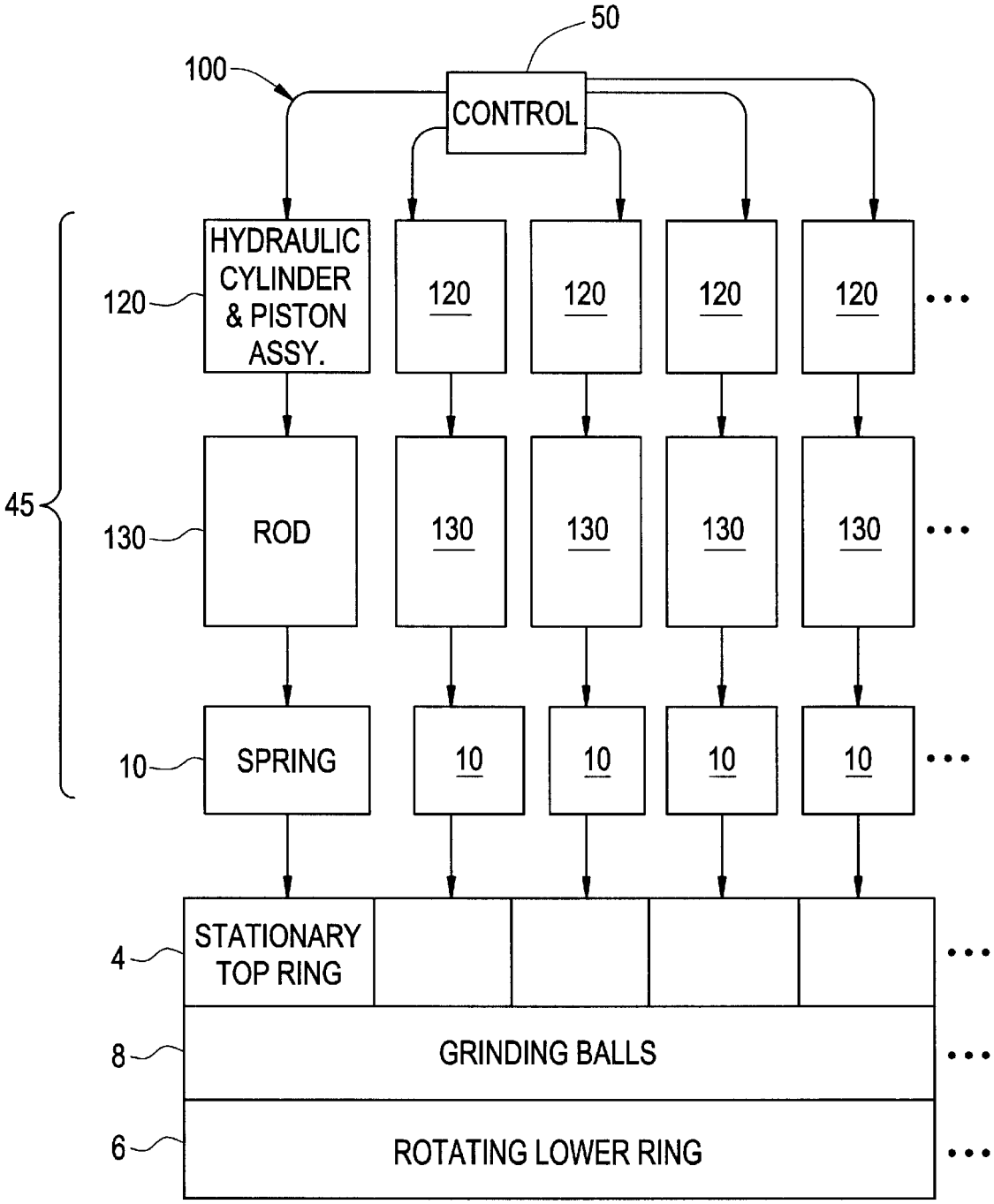
FIG. 3 is a schematic diagram of the hydraulic loading system of the invention.

Referring now to the drawings, in which like reference numerals are used to refer to the same or functionally similar elements, FIG. 3 schematically illustrates the connection of the various components forming the hydraulic loading system 100 of the present invention. The hydraulic loading system 100 replaces the spring loading assemblies 200 known for use with type E and EL pulverizers as shown in FIGS. 1 and 2. The hydraulic loading system 100 comprises several compression assemblies 45 each having a hydraulic cylinder and piston assembly 120 driving a non-threaded rod 130 to compress an associated compression spring 10, which is preferably a single coil spring. The number of compression assemblies 45 is equal to the number of compression springs 10 in the pulverizer. The compression assemblies 45 are thus provided spaced apart around the top of the pulverizer housing 20, and each non-threaded rod 130 extends through the housing 20 and contacts its associated spring 10. As will be described later, the non-threaded rod 130 replaces the threaded rod 24, and the captive nut 58 is replaced by a rod seal 35. In the following discussion, the term compression assembly 45 is meant to include the hydraulic cylinder and piston assembly 120, the non-threaded rod 130, and the spring 10.

Referring again to FIG. 3, each of the hydraulic cylinder and piston assemblies 120 is connected to a hydraulic manifold control assembly 50 using parallel piping so that each cylinder and piston 120 may be simultaneously and equally controlled/pressurized by the hydraulic manifold control assembly 50. The hydraulic manifold control assembly 50 is pressurized by a hydraulic power unit. As indicated above, there is a one-to-one correspondence between the number of springs 10 and the compression assemblies 45 on a given pulverizer. Typically, there are six (6) such springs 10 in this type of pulverizer.

A primary advantage of the hydraulic loading system 100 is that when the compression assemblies 45 are all pressurized at the same time from a common pressure source, the compression spring 10 loading forces are all equal and the loading of all of the compression springs 10 may be accomplished simultaneously, rather than individually. This saves both time and effort and significantly decreases the downtime necessary to set the loading, as well as reduces the need for workers to risk injury climbing on top of pulverizer 2 to adjust springs 10 as with the prior art pulverizers. Adjustments to the compression loading using the loading system 100 may be made much more rapidly as well by simply adjusting the hydraulic pressure at the hydraulic cylinder and piston assemblies 120 with the hydraulic manifold control assembly 50.

Figure 4:
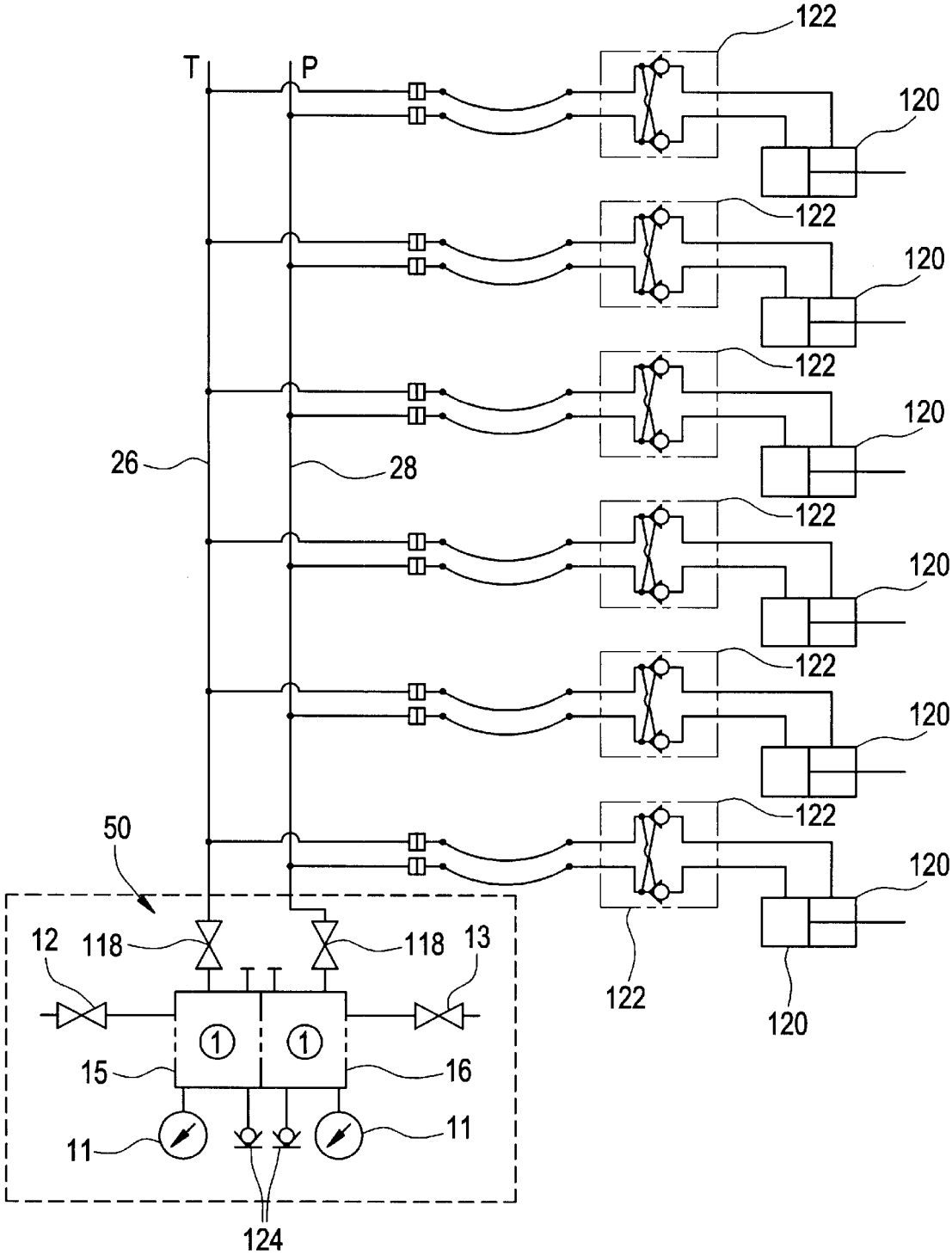
FIG. 4 is a schematic diagram of the hydraulic control system for the loading system of FIG. 3.

FIG. 4 illustrates the connections used to join hydraulic manifold control assembly 50 and hydraulic cylinder and piston assemblies 120. High and low pressure lines 28, 26, respectively, arranged in parallel connect the hydraulic manifold control assembly 50 to the individual hydraulic cylinder and piston assemblies 120 through pilot operated check valves 122. Quick-disconnect fittings 124 are used at the hydraulic manifold control assembly 50 to permit the hydraulic power unit to be removed and used elsewhere once the pressure is set in the cylinders 120, since isolation valves 118 prevent the pressure from escaping once the system is pressurized. Additionally, pilot operated check valves 122 are used at each cylinder to isolate the hydraulic cylinder and piston assemblies 120 from each other if an individual hydraulic cylinder and piston assembly 120 or cylinder hydraulic flex hose "loss of hydraulic pressure" failure occurs.

Inside hydraulic manifold control assembly 50, a set of isolation valves 118 is connected between each of the high and low pressure manifolds 15, 16, and high and low pressure lines 26, 28, respectively. Gauges 11 connected to each manifold indicate the pressure being exerted within each manifold 15, 16, while isolation valves 12, 13, respectively can be used to relieve pressure on the hydraulic manifold control assembly 50.

Figure 5:
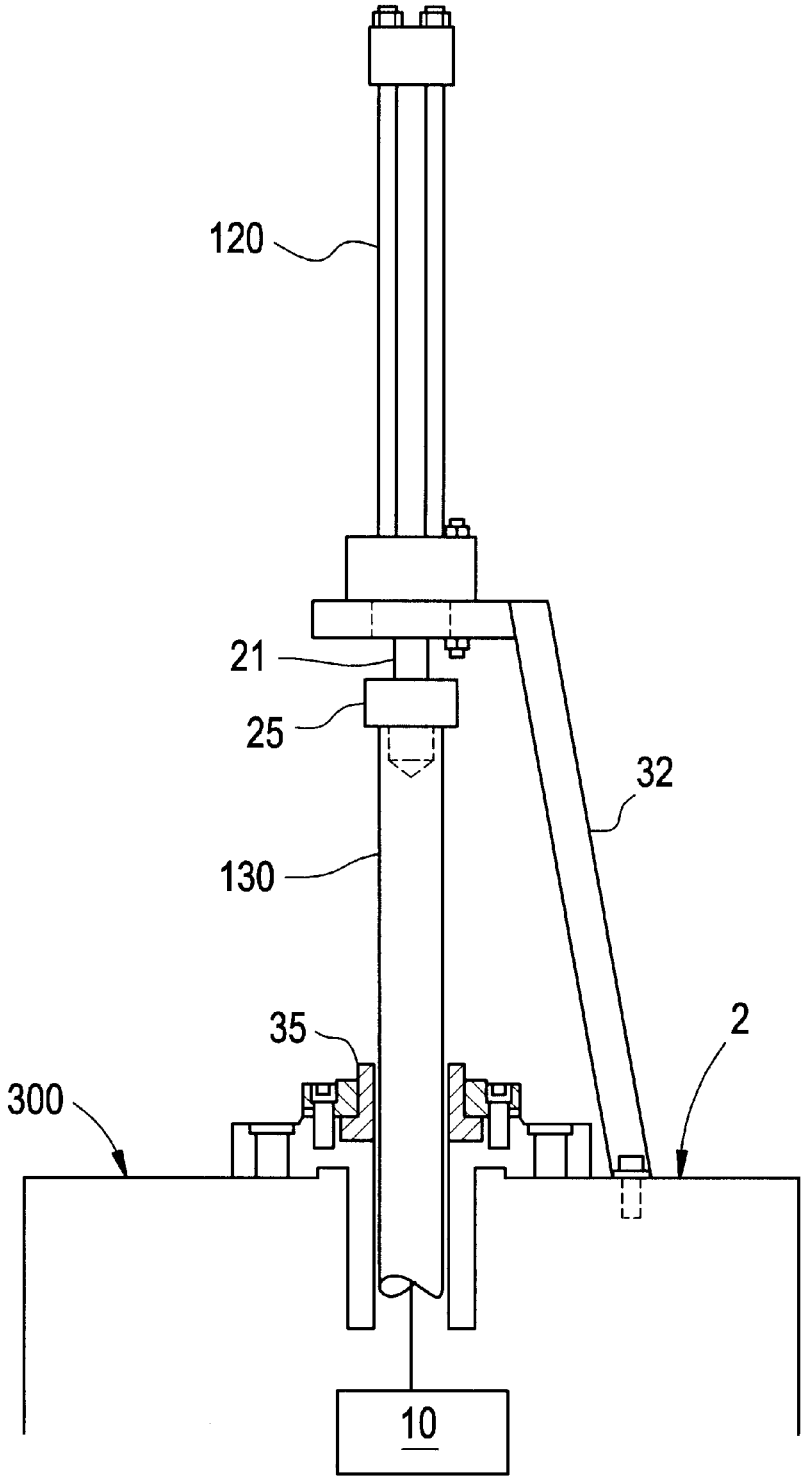
FIG. 5 is a sectional side elevation view of a hydraulic cylinder and rod used with the invention.

FIG. 5 shows the connections between each hydraulic cylinder and piston assembly 120 and non-threaded rod 130 with the upper portion 300 of the pulverizer housing 20. Hydraulic cylinder and piston assembly 120 is supported above the non-threaded rod 130 by support means 32, advantageously a tripod attached to the upper portion 300, to hold it vertically above the pulverizer housing 20. Rod 130 is secured to the end 21 of the hydraulic cylinder and piston assembly 120 by a linear alignment coupling 25. The rod 130 passes sealably through upper portion 300 of the housing 20 via rod seal 35. The lower end of rod 130 is then connected to compression spring 10 for exerting a compressive force.

While a specific embodiment of the invention has been shown and described in detail to illustrate the application of the principles of the invention, it will be understood that the invention may be embodied otherwise without departing from such principles.

What is claimed is:

1. In combination with a ball and ring coal pulverizer having a housing, a stationary top grinding ring, a plurality of grinding balls and a rotating lower grinding ring, a hydraulic loading system for applying a uniform compressive force exerted on the top grinding ring and grinding balls against the lower grinding ring, the hydraulic loading system comprising:

a plurality of hydraulic cylinder and piston assemblies mounted on the upper portion of the housing;

a corresponding plurality of non-threaded rods, each rod connected to one of the pistons of the plurality of hydraulic cylinder and piston assemblies and passing through the upper portion of the housing;

a corresponding plurality of compression springs, each compression spring connected, within the housing, between a corresponding non-threaded rod and the stationary top grinding ring; and control means connected to each of the plurality of hydraulic cylinder and piston assemblies for simultaneously generating the same pressure in each hydraulic cylinder and piston assembly for exerting the uniform compressive force on the top grinding ring.

2. The combination according to claim 1, wherein the control means comprises a manifold connected to each of the plurality of hydraulic cylinder and piston assemblies via parallel piping, and valve means for changing the pressure in the manifold.

3. The combination according to claim 1, wherein the plurality of hydraulic cylinder and piston assemblies comprises six hydraulic cylinder and piston assemblies.

4. The combination according to claim 1, wherein each non-threaded rod is secured to a corresponding hydraulic cylinder and piston assembly by a linear alignment coupling.

5. The combination according to claim 1, wherein each non-threaded rod passes through the upper portion of the housing via an associated rod seal.

6. The combination according to claim 1, wherein each compression spring consists of a single coil.

7. In combination with a ball and ring coal pulverizer having a housing, a stationary top grinding ring, a plurality of grinding balls and a rotating lower grinding ring, a hydraulic loading system for applying a uniform compressive force exerted on the top grinding ring and grinding balls against the lower grinding ring, the hydraulic loading system comprising:

a plurality of non-threaded rods slidably inserted through an upper portion of the housing of the pulverizer;

a corresponding plurality of compression springs, each of the plurality of compression springs connected between each of the plurality of non-threaded rods and the top grinding ring; and hydraulic means using hydraulic pressure for simultaneously and uniformly exerting a force on each of the plurality of non-threaded rods to compress each of the plurality of compression springs a uniform amount and exert the uniform compressive force against the top grinding ring, said hydraulic means mounted on the upper portion of said housing.

* * * * *